United States Patent [19]

Cali

[11] 4,337,915

[45] Jul. 6, 1982

[54] BRICK CLIP-ON HANGER

[76] Inventor: William V. Cali, Rte. #2, Box 122, Chapin, S.C. 29036

[21] Appl. No.: 154,434

[22] Filed: May 29, 1980

[51] Int. Cl.[3] ..... A47G 1/24

[52] U.S. Cl. ..... 248/489; 248/226.5; 248/217.1

[58] Field of Search ..... 248/489, 491, 226.5, 248/539, 217.2, 217.1; 52/27, 714

[56] References Cited

U.S. PATENT DOCUMENTS

| | | | |
|---|---|---|---|
| 287,113 | 10/1883 | Ellithorp | 248/217.2 |
| 1,035,740 | 8/1912 | Raes | 248/217.1 |
| 1,439,302 | 12/1922 | Erickson | 248/217.1 |
| 1,745,814 | 2/1930 | Sadler | 248/539 |
| 2,341,048 | 2/1944 | Kopp | 248/225.3 |
| 3,022,032 | 2/1962 | Walls | 248/205 R |
| 3,837,608 | 9/1974 | Simon | 248/205 A |
| 4,145,840 | 3/1979 | Davidson | 248/217.2 |

FOREIGN PATENT DOCUMENTS

| | | | |
|---|---|---|---|
| 418152 | 10/1934 | United Kingdom | 285/489 |

*Primary Examiner*—Dave W. Arola
*Attorney, Agent, or Firm*—Penrose Lucas Albright

[57] ABSTRACT

A fastening device for being mounting on bricks in a brick wall wherein the mortar is recessed, the fastening device having hooks for hanging framed pictures and other articles. The device is constructed of a single piece of spring steel and has generally three functional parts: a central flat part which bears against one side of the brick and has the hooks extending from the other side which have been stamped to protrude outwardly from the central part; an upper bent part which has been bent over and around in a direction away from the direction that the hooks protrude through an angle, as seen from the side, in a range of 135° to 225° relative to the flat part and preferably about 180° and extending from the edge of the bent part are a plurality of serrations which are adapted to engage the top edge of a brick; and a lower spring part which extends inwardly relative to the central flat part under the brick involved, which, being of a generally "U" configuration with outwardly extending wings inclined upwardly at an angle of about 20 degrees, bears against the lower edge of the brick and thereby resiliently urges the serrations downwardly into a firm engagement with the top edge of the brick.

12 Claims, 3 Drawing Figures

BRICK CLIP-ON HANGER

BACKGROUND OF THE INVENTION

The invention relates to a fastening device which can be readily applied to a brick wall for the purpose of supporting articles such as framed pictures and which does not require damaging the wall as occurs wherein a nail or similar object is caused to penetrate into the brick or mortar between the bricks. More particularly, the invention relates to a fastening device for a brick wall which is resiliently held across at least one brick by parts which insert into recesses existing at the mortar layers.

Various types of fastening devices are known which, by engaging means that may be resilient and include bent portions at the extremities of a central part, are clamped to an object such as a board by the engaging means being biased against opposing surfaces of the object. U.S. Patents which disclose fasteners of this type include U.S. Pat. No. 1,035,740 to Raes, U.S. Pat. No. 1,439,302 to Erickson, U.S. Pat. No. 2,341,048 to Kopp, U.S. Pat. No. 3,022,032 to Walls, and U.S. Pat. No. 3,837,608 to Simon, the latter patent being directed to a holder for a pasteboard dispenser which is formed from a single piece of spring metal shaped to retain the pasteboard dispenser in a desired position.

Other prior art involves a bracket or like member which fits into a groove or opening such as might exist between a pair of bricks and resiliently bears against the opposing facing surfaces. An example of this type of structure can be found in U.S. Pat. No. 4,145,840 of Davidson.

As explained in the foregoing Davidson patent, it has been long recognized that the installation of hangers on a brick wall has been a troublesome problem. The attachment of a relatively permanent wall ties such as threaded hooks or the like can be achieved by drilling or tapping into the mortar between the bricks. Also, specially hardened nails can be driven into the bricks or mortar to provide hangers. However, relatively permanent wall fasteners are time consuming to install and are inflexible for rearrangement purposes. Further, they leave an unsatisfactory appearance after removed. In addition, the use of relatively non-permanent wall hooks, such as applied by adhesive or the like, has been generally undesirable both aesthetically and functionally. Accordingly, there has been a need for some period of time for a fastening device which is easy to install on brick walls, which permits flexibility for rearrangement and which leaves no opening or other defacing features when removed.

SUMMARY OF THE INVENTION

The brick clip-on hanger of the instant invention comprises essentially a coplanar body with hook hangers stamped to extend therefrom and bent portions at the top and bottom which are separated by approximately the height of a single brick. At the bottom, the bent portion includes a resilient U-shaped portion with wings extending outwardly therefrom whereas at the top, downwardly pointed serrated teeth are provided which dig into the brick. The hanger is applied to a brick wall whereby the resilient lower part urges the hanger downwardly so that the serrated teeth are urged into the brick to retain same in place and the hanger is otherwise frictionally mounted on the brick.

The fastener is a one-piece hardware article constructed from spring steel and is so designed that the more weight applied to the hook, the firmer the serrated teeth engage the top edge of the brick and cause the clip to be fastened to the brick. The clip, although originally designed to hold twenty pounds, in actuality is capable of supporting substantially greater weight. It was originally considered that the clip would be limited to use inside a residence to hang pictures and other memorabilia. However the resulting strength of the clip is such that it also may be used outside the residence to mount water hose holders and the like.

The brick clip-on hanger in accordance with the invention has several further advantages which include relative ease of manufacture at reduced cost, the provision of increased efficiency to the owner, effectiveness of function, light weight and a long life. The unique strength of the clip and these advantages are the primary objects of the present invention. Nevertheless, other objects, adaptabilities and capabilities will be recognized as the description progresses, reference being had to the accompanying drawings, in which:

DESCRIPTION OF THE PREFERRED EMBODIMENTS

Figure 1:
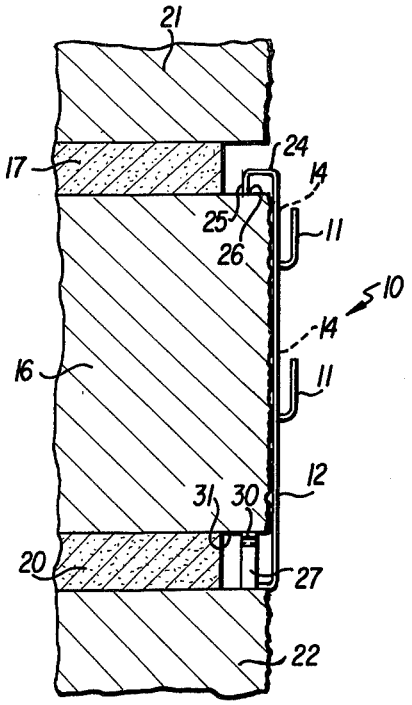
FIG. 1 is a side elevational view illustrating the fastening device in accordance with the invention installed on a brick.
Figure 2:
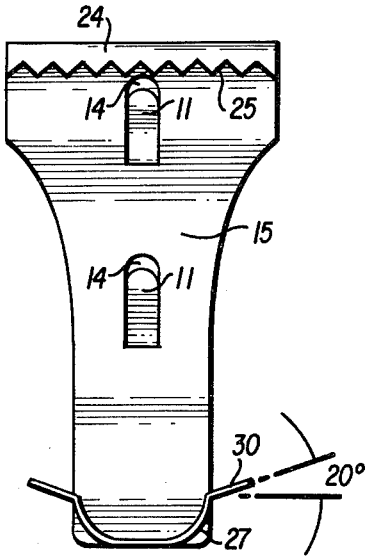
FIG. 2 is a rear elevational view of the invention.
Figure 3:
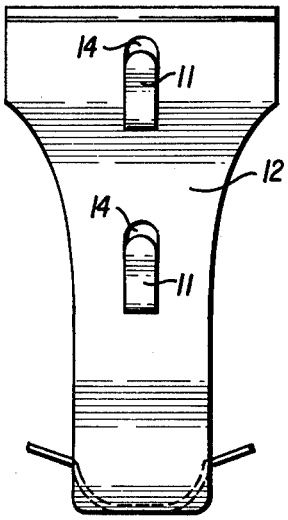
FIG. 3 is a front elevational view of the invention.

Referring to the Figures, it will be seen that the clip-on hanger, designated generally by reference numeral 10, is composed of a single piece of spring steel which has a pair of supporting means comprising hook hangers 11 extending outwardly from the front face of the hanger, having been stamped from openings 14. The unitary hanger 10 has a generally coplanar central part 15, the rear side of which as seen in FIG. 1 bears against a brick 16. Recessed mortar 17 and 20 spaces brick 16 from adjacent bricks 21 and 22.

An upper bent part 24 of hanger 10 extends in a direction away from the front face 12 and, as seen in FIG. 1, extends downwardly at an inclination relative to the horizontal of 90° whereby a plurality of penetrating means comprising serrations or teeth members 25 engage the top edge 26 of brick 16 between bricks 16 and 21.

A lower spring part 27, which is generally of a U-shaped configuration, has a pair of outwardly extending wing portions 30 which, in the unstressed condition, extend outwardly and upwardly at an inclination of about 20 degrees. Such wing portions 30 bear against the lower edge 31 of brick 16 and resiliently urge teeth members 25 into firm engagement with the top edge 26 of brick 16.

Preferably the material in the clip is spring steel of No. 1050 grade which has been heat treated and which has a thickness of 0.025 inches.

As previously indicated, due to the flush mounting of the coplanar part 15 against brick 16 and the serrated teeth members, the addition of more weight onto the hook hangers 11 results in the hanger being held more firmly to the brick. It will also be appreciated that tools or hardware are not required for applying the hanger to the brick inasmuch as the hanger is applied from the bottom portion wherein the hanger is urged upwardly and over the top edge of the brick. Because the clip is unitary, that is a one-piece construction and therefore welding or other connective operations are not required, it can be manufactured easily and at a relatively inexpensive cost.

The drawings show the clip generally proportional although the thickness of the clip may be slightly exaggerated for the purposes of clarification. The distance between the upper part and the lower part of the hanger is about $2\frac{1}{4}$ inches whereas the overall height of the hanger is about $2\frac{3}{4}$ inches.

Although the preferred embodiment of the inventiom is described herein, it is to be understood that it is capable of other adaptations and modifications within the scope of the appended claims. For example different types of material, particularly different types of spring steel, may be utilized and the thickness of the hanger and other dimensions may be modified as necessary for various types of bricks and other applications although it is to be understood that the invention is specifically directed to a hanger for installation on bricks and other similar structural members.

Having thus described my invention, what I claim as new and desire to secure by Letters Patent of the United States is:

1. A fastening device to be mounted on a brick wall for supporting articles and the like therefrom, the device comprising a unitary resilient member which includes: a central generally coplanar part having one side adapted to bear against and overlap one side of a brick, and an opposite side having supporting means; an upper bent part which extends in a direction away from said opposite side through an angle, as seen in side view, of at least 135° relative to said coplanar part and which has a plurality of penetrating means extending therefrom at said angle which are adapted to engage the top edge of a brick for retaining the device in place on the brick; and a lower spring part extending inwardly relative to said coplanar part on the same side of said coplanar part as said upper part and which is spaced below said upper part a distance slightly less than the thickness of the brick to which the device is to be mounted, said spring part comprising flexible stress means with outwardly extending portions movable independently of each other that can be fitted to bear against the lower edge of said brick whereby it resiliently urges said penetrating means downwardly into firm engagement with the top of the brick.

2. A fastening device in accordance with claim 1, wherein said supporting means comprises hook hangers.

3. A fastening device in accordance with claim 2, wherein said hook hangers comprise protrusions of said planar part.

4. A fastening device in accordance with claim 3, wherein said hook hangers consist of two said protrusions.

5. A fastening device in accordance with claim 1, wherein said penetrating means extends at an angle of about 180° relative to said coplanar part.

6. A fastening device in accordance with claim 1, wherein said penetrating means extends at an angle in the range of about 135° to 225° relative to said coplanar part.

7. A fastening device in accordance with claim 1, wherein said penetrating means extends at an angle in the range of 155° to 205° relative to said coplanar part.

8. A fastening device in accordance with claim 1, wherein said penetrating means comprise a plurality of teeth members.

9. A fastening device in accordance with claim 1, wherein the distance between said upper part and said lower part is about $2\frac{1}{4}$ inches.

10. A fastening device in accordance with claim 9, wherein the overall height of the device is about $2\frac{3}{4}$ inches.

11. A fastening device to be mounted on a brick wall for supporting articles and the like therefrom, the device comprising a unitary resilient member which includes: a central generally coplanar part having one side adapted to bear against and overlap one side of a brick, and an opposite side having supporting means; an upper bent part which extends in a direction away from said opposite side through an angle, as seen in side view, of at least 135° relative to said coplanar part and which has a plurality of penetrating means extending therefrom at said angle which are adapted to engage the top edge of a brick for retaining the device in place on the brick; and a lower spring part extending inwardly relative to said coplanar part on the same side of said coplanar part as said upper part and which is spaced below said upper part a distance slightly less than the thickness of the brick to which the device is to be mounted, said lower spring part having a U-shaped configuration with wing portions extending therefrom which are adapted to bear against the bottom edge of the brick, said wing portions inclined outwardly and upwardly from both ends of said lower spring part, said lower spring part adapted to bear against the lower edge of said brick whereby it resiliently urges said penetrating means downwardly into firm engagement with the top edge of the brick.

12. A fastening device in accordance with claim 11, wherein each of said wing portions extend outwardly and upwardly at an angle of about 20° relative to the horizontal when not bearing against the bottom edge of the brick in a state of tension.

* * * * *